US011859855B2

(12) United States Patent
Galkin

(10) Patent No.: US 11,859,855 B2
(45) Date of Patent: Jan. 2, 2024

(54) APPARATUS AND METHOD FOR REDIRECTING AIR THROUGH REGISTER ACCESS CAVITIES OF AN AIR HEATING AND COOLING SYSTEM

(71) Applicant: William S. Galkin, Baltimore, MD (US)

(72) Inventor: William S. Galkin, Baltimore, MD (US)

( * ) Notice: Subject to any disclaimer, the term of this patent is extended or adjusted under 35 U.S.C. 154(b) by 286 days.

(21) Appl. No.: 17/192,004

(22) Filed: Mar. 4, 2021

(65) Prior Publication Data

US 2022/0282889 A1 Sep. 8, 2022

(51) Int. Cl.
*F24F 13/08* (2006.01)
*F24F 13/14* (2006.01)

(52) U.S. Cl.
CPC ..... *F24F 13/081* (2013.01); *F24F 13/082* (2013.01); *F24F 13/14* (2013.01)

(58) Field of Classification Search
CPC ..... F24F 13/081; F24F 13/082; F24F 13/14; F24F 13/06; F24F 13/065; F24F 13/068; F24F 13/075; F24F 13/08; F24F 13/084; F24F 13/1486; F24F 13/15; F24F 13/18; F24F 7/007; F24F 7/013; F24F 7/04; F24F 7/10
USPC ..... 454/306
See application file for complete search history.

(56) References Cited

U.S. PATENT DOCUMENTS 2,719,476 A * 10/1955 Dovolis ..... F24F 13/062 99/329 R
2013/0072104 A1* 3/2013 Picco ..... F24F 13/085 454/289
2014/0326794 A1* 11/2014 Frank ..... F24F 11/523 236/51
2021/0101452 A1* 4/2021 Ovando Sánchez .. F24F 13/075

FOREIGN PATENT DOCUMENTS

CN 106440173 A * 2/2017 ..... E04D 13/143

OTHER PUBLICATIONS

Cui, Jinjing, CN106440173 Translation.pdf, "Lighting and ventilation device for earth-sheltered dewlling and contstruction process thereof", Feb. 2017, pp. 1-10.*

* cited by examiner

*Primary Examiner* — Avinash A Savani
*Assistant Examiner* — Ryan L Faulkner
(74) *Attorney, Agent, or Firm* — _Stephen P. Scuderi; Heslin Rothenberg Farley & Mesiti PC

(57) ABSTRACT

An air redirect apparatus for redirecting forced air through a register access cavity. The air redirect apparatus includes a duct elbow configured to fit into a register access cavity. The duct elbow includes an entrance aperture and an exit aperture. The entrance aperture is sized to connect to a duct opening of ductwork, which routes forced air into the register access cavity. The apparatus also includes a cover plate connected to the entrance aperture and through which the entrance aperture penetrates. The cover plate is sized to cover the duct opening of the ductwork when the entrance aperture is connected to the duct opening. When the duct elbow is fit into the register access cavity, air flow from the ductwork is routed into the entrance aperture and directed out of the exit aperture of the duct elbow, while the cover plate substantially blocks air flow around the duct elbow.

17 Claims, 10 Drawing Sheets

APPARATUS AND METHOD FOR REDIRECTING AIR THROUGH REGISTER ACCESS CAVITIES OF AN AIR HEATING AND COOLING SYSTEM

TECHNICAL FIELD

The present disclosure relates to heating ventilating and air conditioning (hvac) devices and methods of making the same. More specifically, the disclosure relates to devices and methods for redirecting air flow through register access chambers of a forced air system for more efficient central heating and air conditioning.

BACKGROUND

Many older homes (for example from 1940's through the 1960's) have been built with forced air heating systems designed and installed to provide heat throughout the house, but not designed to provide any air conditioning. Later, when the technology for central air conditioning became more prevalent and cost effective, the owners of those older homes had their home's forced air heating systems converted for additional use with a central air conditioning system.

However, purely forced air heating systems of older homes generally use narrower ducts than that of a central air conditioning system in a more modern home. Accordingly, the ductworks of forced air heating systems in older homes are not ideal for modern central air conditioning systems.

More specifically, in addition to having a narrower cross sectional area than modern air conditioning ductwork, the ducting of an older home's air heating system often enters a register access cavity that is positioned between the duct work and a register in the wall of the home. The duct work in an older home often has a much smaller cross sectional area than the register access cavity. Accordingly, the air flow slows in velocity and swirls around in the register access cavity before it crosses the register and enters a room of the home.

For purposes herein, the term "register" refers to a framed cover mounted against an opening in a wall or floor that regulates the admission of air flow from a forced air system into a room. The register will often have dampers, louvers or shutters though which forced air from ductwork of the forced air system must flow before the forced air can enter a room.

The result is that air crosses the register, and flows out into the room at a slower velocity than that of the air flow traveling through the duct work. This works fine for heat, which rises when it enters the room. However, cold air sinks when it enters a room. Therefore, in order to adequately cool a room, cold air needs to flow out with relatively more velocity in order to circulate properly.

Moreover, because the air flow slows substantially when it enters a register access cavity, the flow of air does not have a well defined direction of flow, which can be desirable to the home owner. Additionally, the register itself often does not have adequate capability of directing the air flow after the flow of air has had its velocity diminished upon entering the register access cavity.

Accordingly, there is a need for an apparatus and method for redirecting forced air passing through a register access cavities of a forced air heating and cooling system such that the velocity of air does not significantly diminish when it passes through the register access cavity and into a room. Additionally, there is a need to provide more air flow direction from a register access cavity into a room than a typical register is capable of providing.

BRIEF DESCRIPTION

The present disclosure offers advantages and alternatives over the prior art by providing an air redirect apparatus for redirecting forced air through a register access cavity and into a room. The air redirect apparatus includes a duct elbow connected to, and penetrating through, a cover plate. The duct elbow is configured to connect to a duct opening of ductwork which directs forced air into the duct elbow. The cover plate is configured to cover the entire duct opening and to substantially prevent air flow around the duct elbow. The duct elbow has a minimum cross sectional area that is smaller than the cross sectional area of the ductwork. Because of the duct elbow's smaller cross sectional area, the air flow is accelerated as it passes from the duct opening to the duct elbow. The increased velocity of air enables the room to be heated and cooled more efficiently.

Additionally, the duct elbow may rotate clockwise or counterclockwise to direct air flow leftward or rightward into the room. The duct elbow may also include louvers on an exit aperture of the duct elbow to direct air upward or downward into the room. Alternatively, the exit aperture of the duct elbow may include an air redirect valve, which can rotate clockwise and counterclockwise to direct air leftward or rightward. The air redirect valve may also include louvers to direct air upward or downward. Alternatively, the exit aperture of the duct elbow may include louvers in the exit aperture to direct air flow upwards or downwards and an air redirect plate proximate the louvers to direct air flow leftwards or rightwards.

An air redirect apparatus for redirecting forced air through a register access cavity in accordance with one or more aspects of the present disclosure includes a duct elbow configured to fit into a register access cavity. The duct elbow includes an entrance aperture and an exit aperture. The entrance aperture is sized to connect to a duct opening of ductwork, which routes forced air into the register access cavity. The apparatus also includes a cover plate connected to the entrance aperture and through which the entrance aperture penetrates. The cover plate is sized to cover the duct opening of the ductwork when the entrance aperture is connected to the duct opening. When the duct elbow is fit into the register access cavity, air flow from the ductwork is routed into the entrance aperture and directed out of the exit aperture of the duct elbow, while the cover plate substantially blocks air flow around the duct elbow.

Another air redirect apparatus for redirecting forced air through a register access cavity in accordance with one or more aspects of the present disclosure includes a duct elbow configured to fit into a register access cavity. The duct elbow includes an entrance aperture and an exit aperture. The entrance aperture is sized to connect to a duct opening of ductwork which routes forced air into the register access cavity. The duct elbow has a minimum cross sectional area that is less than the cross sectional area of the duct opening. A cover plate is connected to the entrance aperture and through which the entrance aperture penetrates. The cover plate is sized to cover the duct opening of the ductwork when the entrance aperture is connected to the duct opening. When the duct elbow is fit into the register access cavity, air flow from the ductwork is routed into the entrance aperture and directed out of the exit aperture of the duct elbow, while the cover plate substantially blocks air flow around the duct elbow. Additionally, velocity of forced air being directed out of the exit aperture is greater than velocity of forced air passing through the ductwork adjacent to the duct opening.

In some examples of the air redirect apparatus, the entrance aperture and the exit aperture are oriented at substantially 90 degrees relative to each other.

In some examples of the air redirect apparatus, velocity of forced air directed out of the exit aperture, and into a room is greater than velocity of forced air directed into the room when the duct elbow is not connected to the duct opening of the duct work.

In some examples of the air redirect apparatus, the entrance aperture and exit aperture of the duct elbow each have a cross sectional area that is less than the cross sectional area of the duct opening. The velocity of the forced air being directed out of the exit aperture is greater than velocity of forced air passing through the ductwork adjacent to the duct opening.

In some examples of the air redirect apparatus, the cover plate has an adjustable length that is operable to be adjusted to a maximum length that is greater than a maximum length of the duct opening.

In some examples of the air redirect apparatus, a top plate has a first pair of retainer tabs disposed on a first side of the top plate and a second pair of retainer tabs disposed on an opposing second side of the top plate. A bottom plate has a thickness sized to slidably fit within the first and second pairs of retainer tabs of the top plate. The bottom plate includes a cutout section configured to straddle an outer perimeter of the entrance aperture of the duct elbow. The bottom plate is operable to slide longitudinally within the retaining tabs to adjust the maximum length of the cover plate.

In some examples of the air redirect apparatus, the cover plate is pivotably connected to the entrance aperture such that the duct elbow is operable to rotate clockwise and counterclockwise relative to the cover plate to direct forced air flow leftward or rightward.

In some examples of the air redirect apparatus, a plurality of substantially parallel louvers extend across the exit aperture of the duct elbow. The louvers are operable to pivot upward and downward to direct forced air flow upward or downward.

In some examples of the air redirect apparatus, an air redirect plate is disposed within the duct elbow proximate the exit aperture and upstream of the louvers. The air redirect plate includes an outer perimeter which substantially conforms to an inner perimeter of the duct elbow. The air redirect plate is pivotally connected to a top wall portion and an opposing bottom wall portion of the duct elbow such that the air redirect plate is operable to rotate clockwise and counterclockwise relative to the cover plate to direct forced air flow leftward or rightward.

In some examples of the air redirect apparatus, an air redirect valve is disposed within the exit aperture. The air redirect valve includes a valve frame having an outer perimeter which substantially conforms to an inner perimeter of the exit aperture. The valve frame is pivotally connected to a top wall portion and an opposing bottom wall portion of the exit aperture such that the valve frame is operable to rotate clockwise and counterclockwise relative to the cover plate to direct forced air flow leftward or rightward. A plurality of substantially parallel louvers extend across the valve frame. The louvers are operable to pivot upward and downward to direct forced air flow upward or downward.

In some examples of the air redirect apparatus, the valve frame of the air redirect valve includes a ring having a substantially circular outer perimeter which substantially conforms to a substantially circular inner perimeter of the exit aperture. The ring is pivotally connected to the top and bottom wall portions of the exit aperture across an axis of the ring which extends through a diameter of the ring.

In some examples of the air redirect apparatus, a register replacement plate has an exit aperture hole sized to receive the exit aperture therethrough. The register replacement plate is operable to mount over a wall opening of the register access cavity.

In some examples of the air redirect apparatus, the register replacement plate is rigidly connected to the duct elbow and the exit aperture of the duct elbow protrudes through the exit aperture hole of the register replacement plate.

It should be appreciated that all combinations of the foregoing concepts and additional concepts discussed in greater detail below (provided such concepts are not mutually inconsistent) are contemplated as being part of the inventive subject matter disclosed herein and may be used to achieve the benefits and advantages described herein.

DRAWINGS

The disclosure will be more fully understood from the following detailed description taken in conjunction with the accompanying drawings, in which.

DETAILED DESCRIPTION

Certain examples will now be described to provide an overall understanding of the principles of the structure, function, manufacture, and use of the methods, systems, and devices disclosed herein. One or more examples are illustrated in the accompanying drawings. Those skilled in the art will understand that the methods, systems, and devices specifically described herein and illustrated in the accompanying drawings are non-limiting examples and that the scope of the present disclosure is defined solely by the claims. The features illustrated or described in connection with one example maybe combined with the features of other examples. Such modifications and variations are intended to be included within the scope of the present disclosure.

The terms "significantly", "substantially", "approximately", "about", "relatively," or other such similar terms that may be used throughout this disclosure, including the claims, are used to describe and account for small fluctuations, such as due to variations in processing from a reference or parameter. Such small fluctuations include a zero fluctuation from the reference or parameter as well. For example, they can refer to less than or equal to ±10%, such as less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Figure 1:
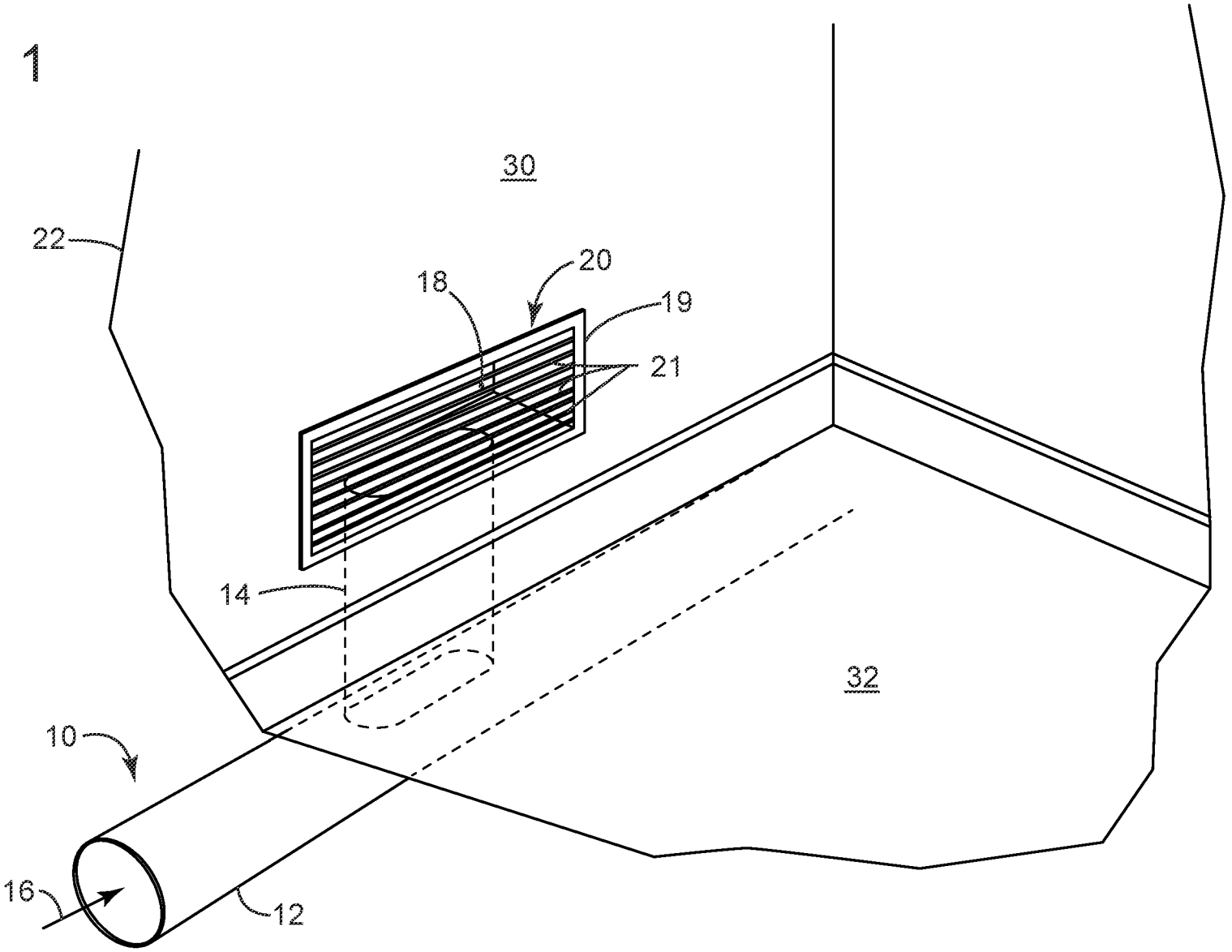
FIG. 1 depicts an example of a perspective view of a portion of a forced air heating and cooling system, which includes ductwork for directing air flow into a register access cavity, passed a wall mounted register and into a room, according to aspects described herein.

Referring to FIG. 1, an example is depicted of a perspective view of a portion of a forced air system 10, which includes ductwork 12 and 14 for directing air flow (depicted by directional arrow 16) into a register access cavity 18 (better seen in FIGS. 2 and 3), passed a wall mounted register 20 and into a room 22, according to aspects described herein. The forced air system 10 may have been originally used as a forced air heating system for an older home and later converted to a forced air heating and cooling system.

The register 20, as illustrated in FIG. 1, includes a frame 19 with a plurality of parallel louvers 21 that extend longitudinally across the frame 19. The register functions as a cover, which is mounted over the wall opening 28 in the wall 30. The register 20 regulates and/or enables the admission of air flow 16 from the forced air system 10 into the room 22.

Figure 2:
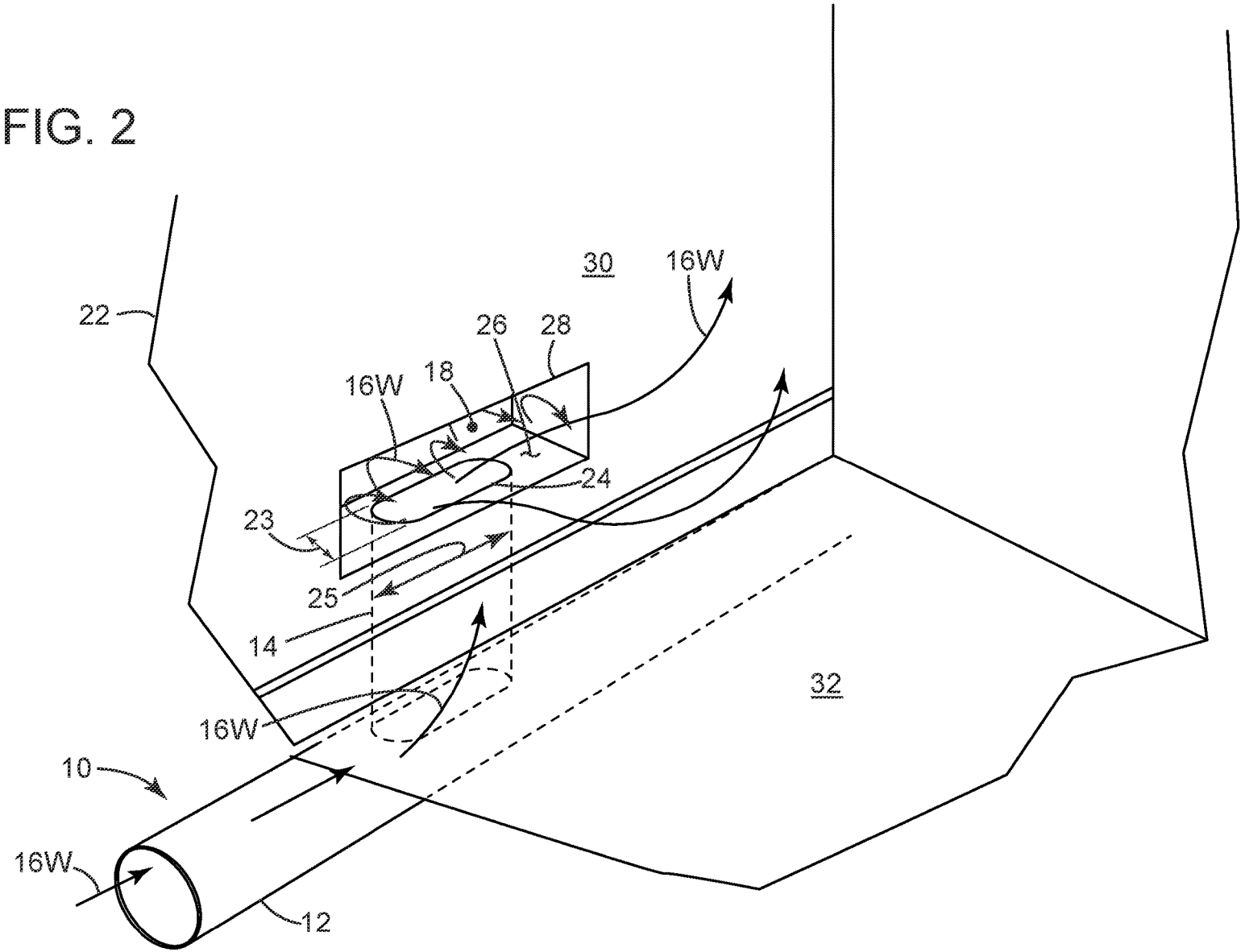
FIG. 2 depicts an example of a perspective view of forced warm air being directed through the register access cavity of FIG. 1, according to aspects described herein.

Referring to FIG. 2, an example is depicted of a perspective view of forced warm air (depicted by directional arrows 16W) being directed through the register access cavity 18, according to aspects described herein. The register access cavity 18 includes a duct opening 24 having a maximum length 25 and a maximum width 23. The register access cavity 18 also includes a wall opening 28. The duct opening 24 of the register access cavity is positioned in a cavity floor 26 of the register access cavity 18 and is connected the duct work 14 adjacent to the register access cavity 18. The wall opening 28 is positioned in a wall 30 of the room 22.

As indicated by the directional arrows 16W, the forced warm air will flow through ductwork 14 and enter into the register access cavity 18 through duct opening 24. Once in the cavity 18, the warm air 16W will swirl around the register access cavity and loose velocity prior to spilling into room 22 through the wall opening 28. However, because the forced warm air 16W is lighter in density than room temperature air, the air flow will rise (as indicated by directional arrows 16W) as it enters the room 22. The rising forced warm air 16W aids in mixing with the room temperature air of the room 22, but has little directional control when exiting the register access cavity 18.

Figure 3:
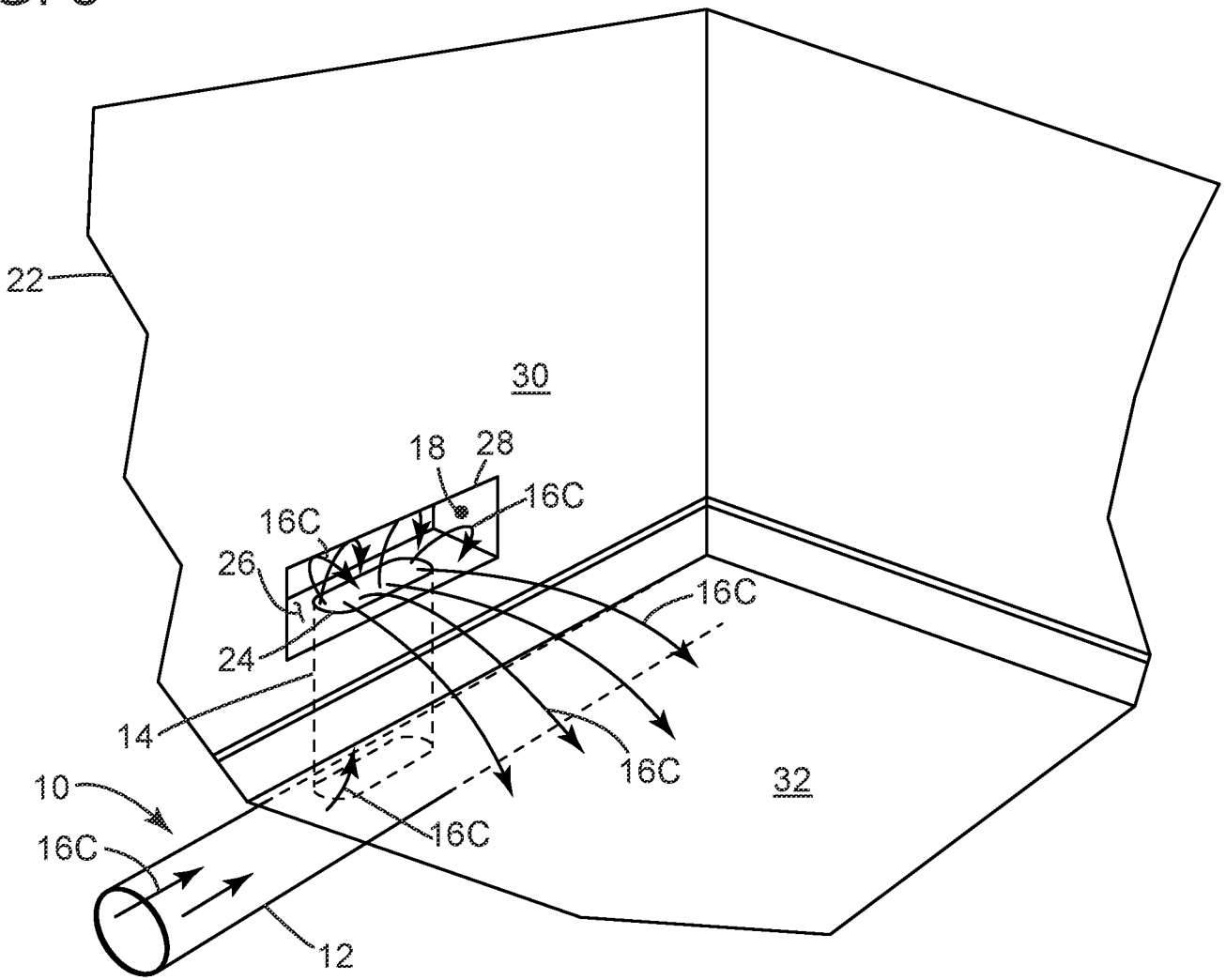
FIG. 3 depicts an example of a perspective view of forced cool air being directed through the register access cavity of FIG. 1, according to aspects described herein.

Referring to FIG. 3, an example is depicted of a perspective view of forced cool air (depicted by directional arrows 16C) being directed through the register access cavity 18, according to aspects described herein.

As indicated by the directional arrows 16C, the forced cool air will flow through ductwork 14 and enter into the register access cavity 18 through duct opening 24. Once in the cavity 18, the cool air 16C will swirl around the register access cavity 18 and loose velocity prior to spilling into room 22 through the wall opening 28. However, because the forced cool air 16C is heavier in density than room temperature air, the air flow will sink (as indicated by directional arrows 16C) as it enters the room 22. The sinking forced cool air 16C is detrimental in cooling the room because the cool air tends to remain in a lower half of the room and does not mix well with the room temperature air in the upper half of the room. Additionally, the cool air 16C has little directional control when exiting the register access cavity 18.

Figure 4:
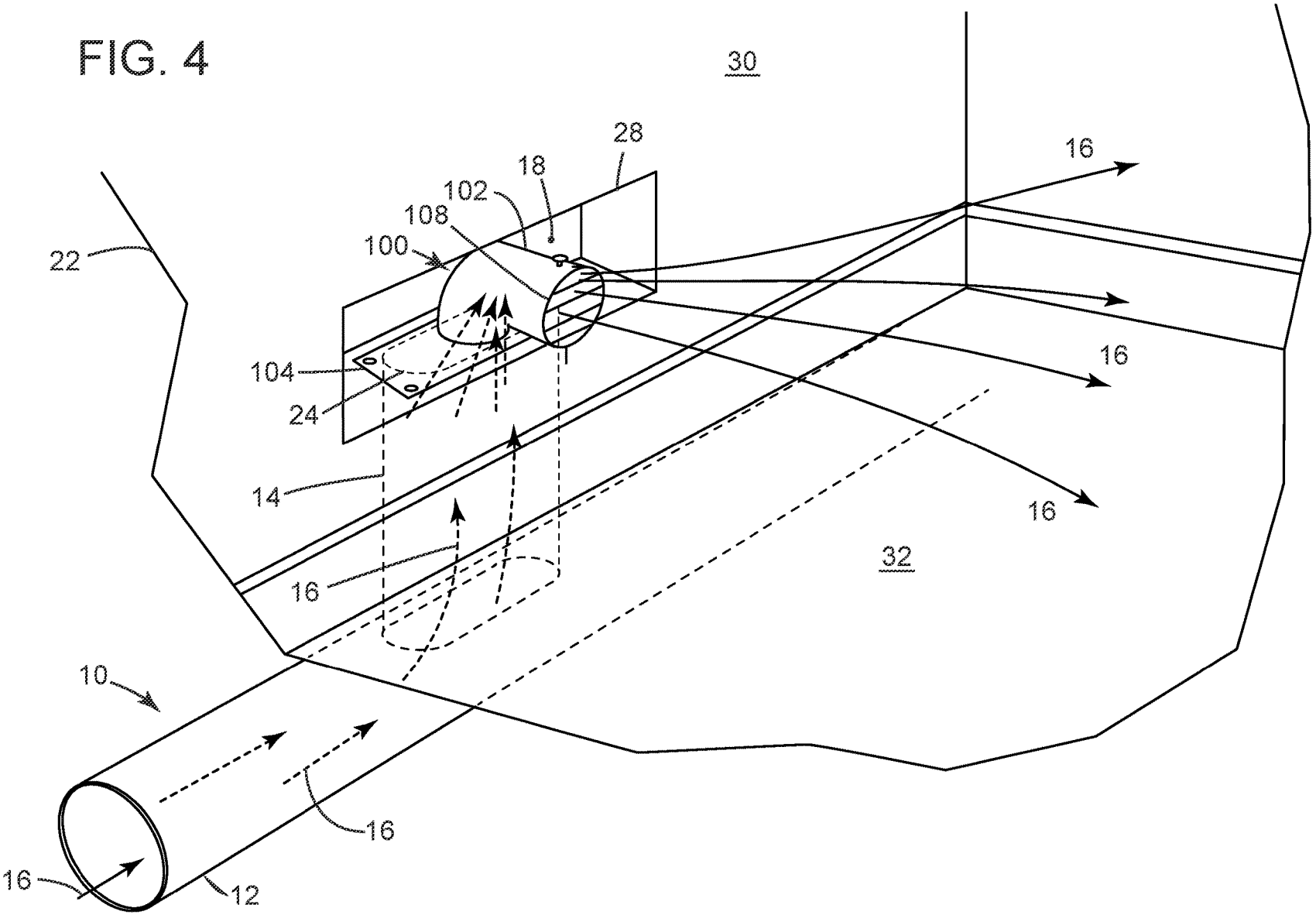
FIG. 4 depicts an example of a perspective view of forced air being directed through an air redirect apparatus installed within the register access cavity of FIG. 1, according to aspects described herein.

Referring to FIG. 4, an example is depicted of a perspective view of forced air 16 of a forced air system 10 being directed through an air redirect apparatus 100 installed within the register access cavity 18, according to aspects described herein. For purposes of clarity, the register 20 is not shown in FIG. 4, but would normally be mounted over the wall opening 28.

The air redirect apparatus 100 redirects substantially all of the forced air 16 from ductwork 14 into the room 22 and substantially prevent any air flow from bypassing the air redirect apparatus 100. Accordingly, the air flow 16 enters the room from the register access cavity 18 at a substantially greater velocity than the velocity of the air flow within the ductwork 14. Additionally, the air flow 16 enters the room 22 at a substantially greater velocity than it would have if the air redirect apparatus 100 where not installed within the register access cavity 18.

The air redirect apparatus includes a duct elbow 102 and a cover plate 104. The duct elbow 102 is configured to fit into the register access cavity 18. The duct elbow 102 includes an entrance aperture 106 (see FIG. 5), wherein the air flow 16 enters the duct elbow, and an exit aperture 108, wherein the air flow 16 exits the duct elbow. The entrance aperture 106 is sized to connect to the duct opening 24 of the ductwork 14 which routes the forced air 16 into the register access cavity 18.

In the example illustrated in FIG. 1, the entrance aperture 106 and exit aperture 108 are oriented at substantially 90 degrees relative to each other. However, it is within the scope of this invention, that the entrance aperture 106 and exit aperture 108 may be oriented at other acute or obtuse angles relative to each other.

The cover plate 104 is connected to the entrance aperture 106. Additionally, the entrance aperture 106 penetrates through the cover plate 104 to allow air flow 16 from the ductwork 14 to flow into the duct elbow 102. The cover plate 104 is longer than the maximum length 25 of the duct opening 24 and is sized to cover the duct opening 24 of the ductwork 14 when the entrance aperture 106 is connected to the duct opening 24. Accordingly, when the duct elbow 102 of the air redirect apparatus 100 is fit into the register access cavity 18, the air flow 16 from the ductwork 14 is routed into the entrance aperture 106 and directed out of the exit aperture 108 of the duct elbow 102, while the cover plate 104 of the air redirect apparatus 100 substantially blocks air flow 16 around the duct elbow 102.

Due to the design of the air redirect apparatus 100, velocity of forced air 16 that is directed out of the exit aperture 108 and into room 22 is greater than velocity of forced air 16 that would be directed into the room 22 when the duct elbow 102 is not connected to the duct opening 24 of the duct work 14. This is due in large part because the entrance aperture 106 and exit aperture 108 of the duct elbow 102 each may have a cross sectional area that is less than the cross sectional area of the duct opening 24. Additionally, the duct elbow may have a minimum cross sectional area that is less than the cross sectional area of the duct opening 24. Accordingly, the velocity of the forced air 16 being directed out of the exit aperture 108 is greater than velocity of forced air 16 passing through the ductwork 14 adjacent to the duct opening 24.

The velocity of the forced air 16 being directed into the room 22 from the register access cavity 18 by the air redirect apparatus 100 may be as much as 2 to 3 times greater than the velocity of force air that would be directed into the room 22 from the register access cavity 18 without the air redirect apparatus 100 being installed in the register access cavity 18. As such, the forced air 16, whether it be warm forced air 16W (see FIG. 2) or cool forced air 16C (see FIG. 3), will mix more quickly and thoroughly with room temperature air than the forced air 16 would without the air redirect apparatus 100 installed. Therefore, the air redirect apparatus 100 enhances both heating and cooling of the room 22.

Figure 6:
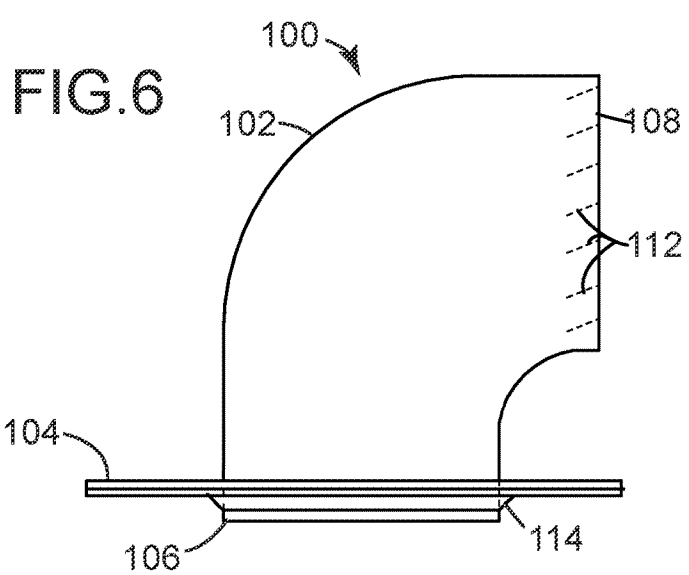
FIG. 6 depicts an example of a side view of the air redirect apparatus of FIG. 4, according to aspects described herein.
Figure 5:
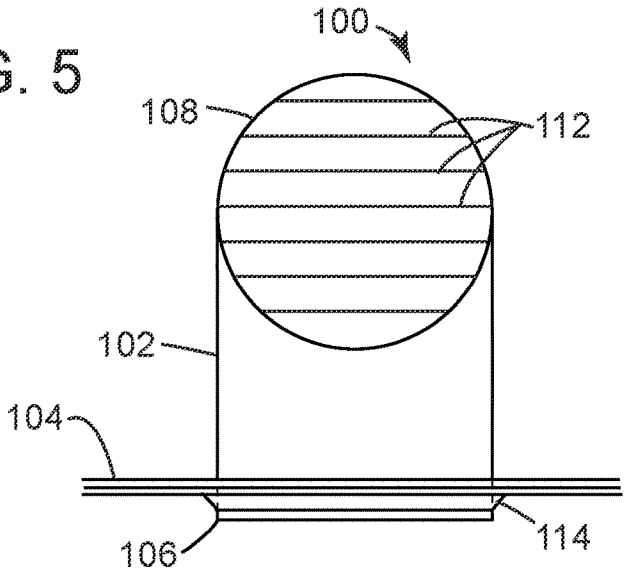
FIG. 5 depicts an example of a front view of the air redirect apparatus of FIG. 4, according to aspects described herein.
Figure 7:
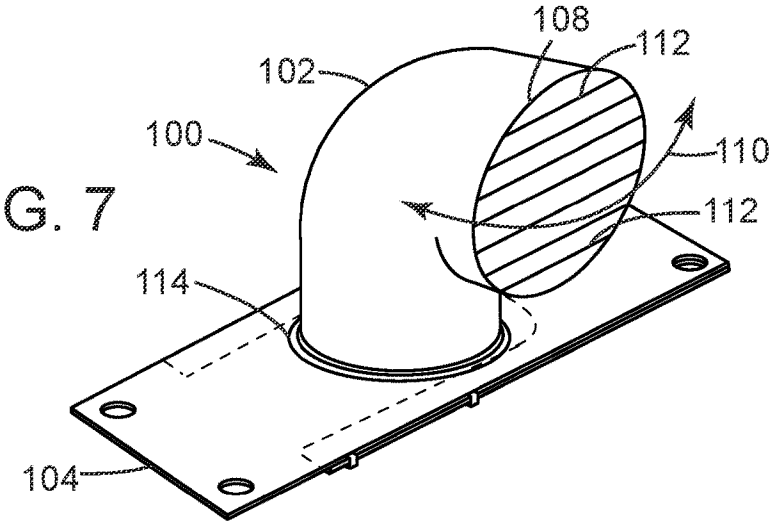
FIG. 7 depicts an example of a perspective view of the air redirect apparatus of FIG. 4, according to aspects described herein.

Referring to FIGS. 5, 6 and 7, a front view (FIG. 5), a sideview (FIG. 6) and a perspective view (FIG. 7) are depicted of the air redirect apparatus 100, according to aspects described herein. The cover plate 104, may be pivotably connected, via a swivel connection 114, to the entrance aperture 106 such that the duct elbow 102 is operable to rotate clockwise and counterclockwise (as indicated by arrow 110) relative to the cover plate 104 to direct forced air flow 16 leftward or rightward into room 22.

The terms: "leftward" and "rightward", as used herein, shall refer to directing air flow 16 substantially horizontally relative to the floor 32 of the room 22 and toward the left side or right side respectively of the room 22.

The pivotal connection 114 may include overlapping rims on the entrance aperture 106 and cover plate 104, which may swivel relative to each other. The pivotal connection 114 may also include any of several other design features that may be appropriate.

By enabling the duct elbow 102 to rotate clockwise and counterclockwise relative to the cover plate 104, the air redirect apparatus 100 can more selectively direct air flow from left to right within a room. This provides better horizontal directional control of the air flow 16 entering the room 22 from the register access cavity 18 than can be accomplished without the air redirect apparatus 100 installed.

In the example illustrated in FIGS. 5-7, the air redirect apparatus 100 also includes a plurality of substantially parallel louvers 112 extending across the exit aperture 108 of the duct elbow 102. The louvers are operable to pivot upward and downward to direct forced air flow upward or downward.

The terms: "upward" and "downward", as used herein, shall refer to directing air flow 16 substantially vertically relative to the wall 30 of the room 22 and toward a ceiling (upward) or the floor 32 respectively of the room 22.

By enabling the louvers 112 to pivot upward or downward, the air redirect apparatus 100 can more selectively direct air flow from up or down within a room. This provides better vertical directional control of the air flow 16 entering the room 22 from the register access cavity 18 than can be accomplished without the air redirect apparatus 100 installed.

Figure 8A:
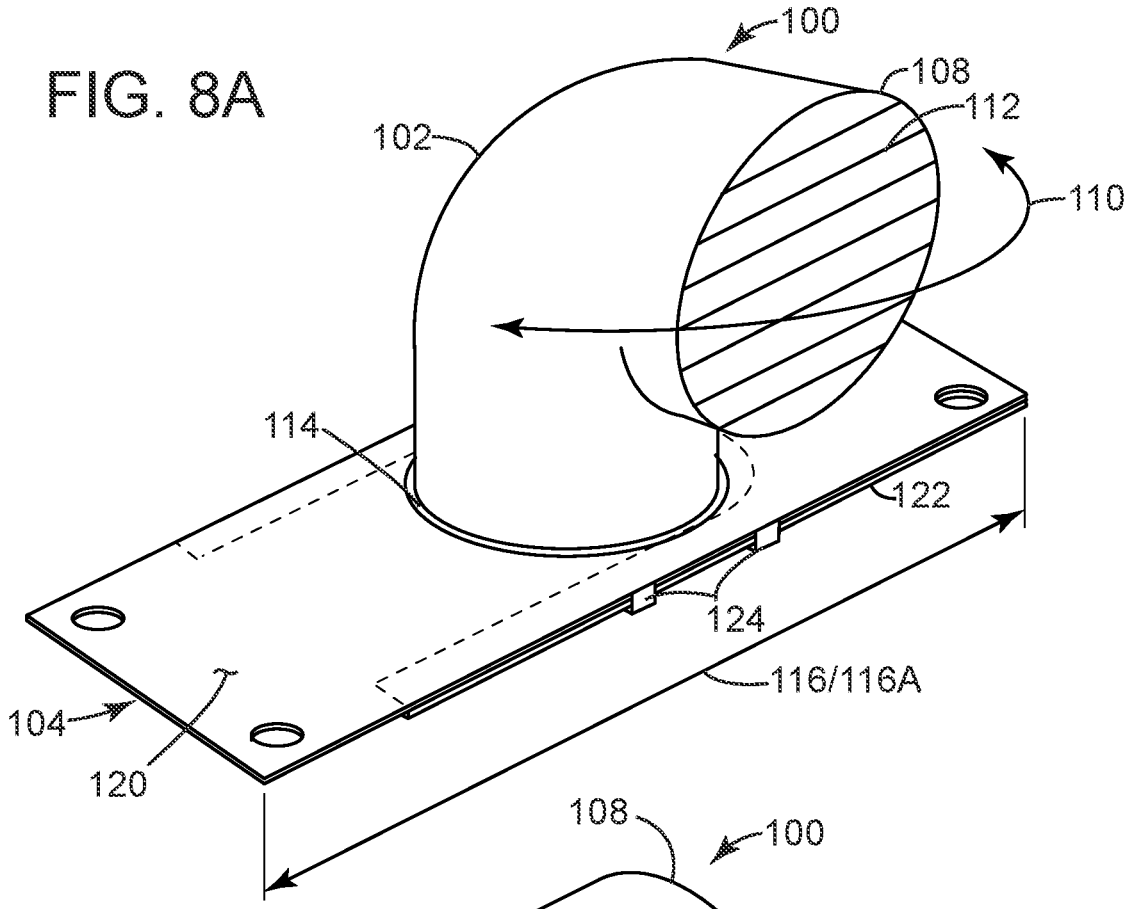
FIG. 8A depicts an example of a front perspective view of the air redirect apparatus of FIG. 4 with an adjustable cover plate set to a minimum length, according to aspects described herein.
Figure 8B:
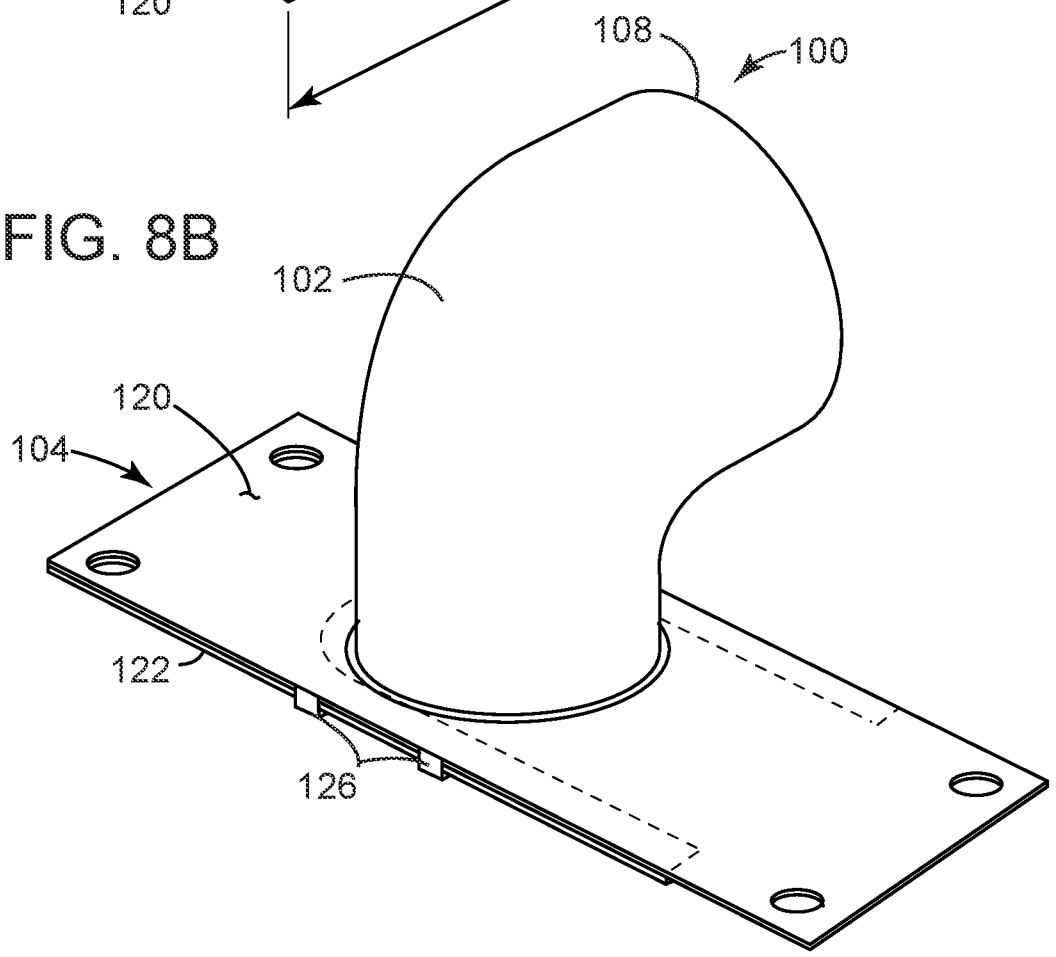
FIG. 8B depicts an example of a rear perspective view of the air redirect apparatus of FIG. 4 with the adjustable cover plate set to a minimum length, according to aspects described herein.

Referring to FIGS. 8A and 8B, an example is depicted of a front perspective view (FIG. 8A) and a rear perspective view (FIG. 8B) of the air redirect apparatus 100 with an adjustable cover plate 104 set to a minimum length 116A, according to aspects described herein.

Figure 9:
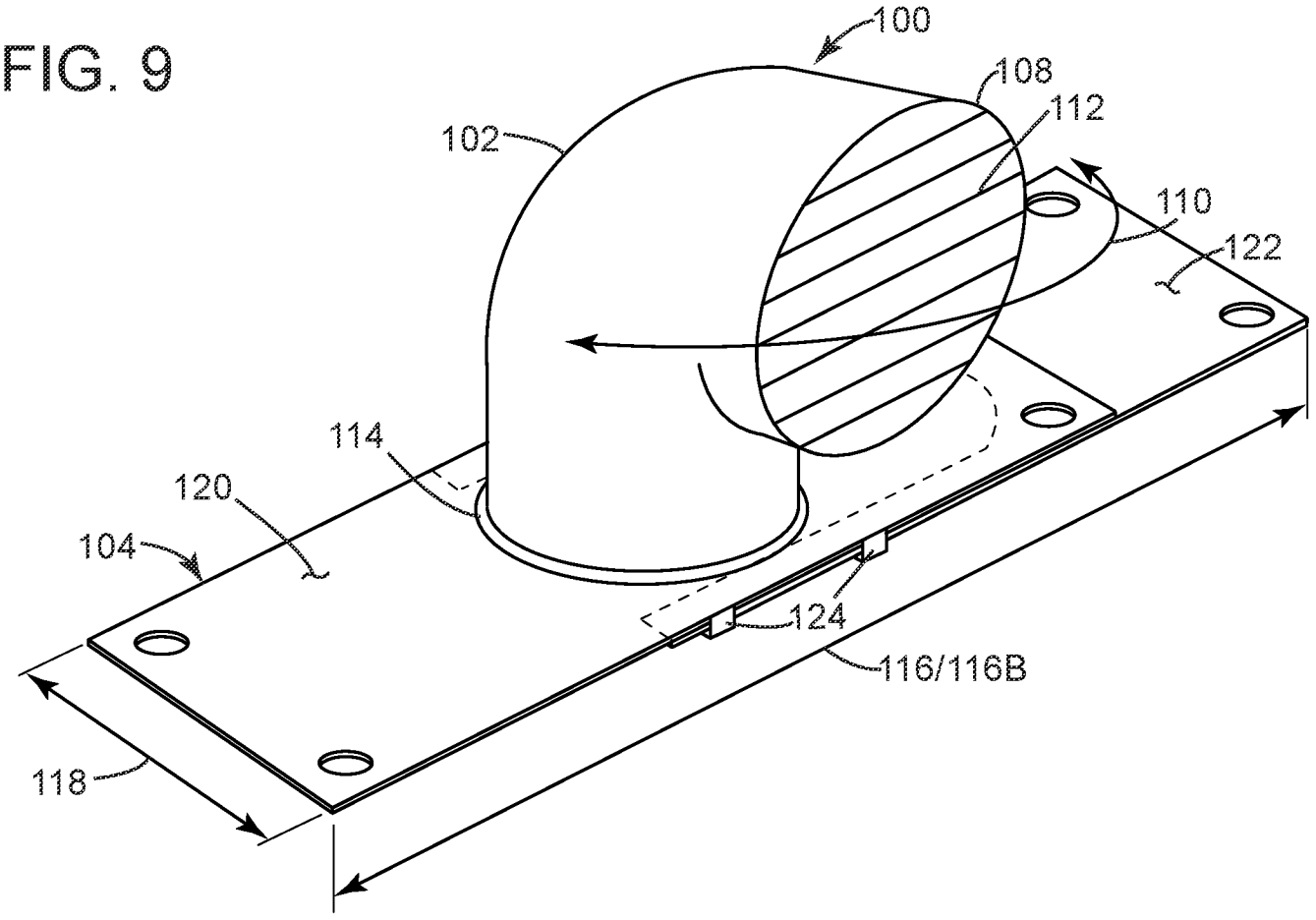
FIG. 9 depicts an example of another perspective view of the air redirect apparatus of FIG. 4 with the adjustable cover plate set to a maximum length, according to aspects described herein.

Also referring to FIG. 9, an example is depicted of a perspective view of the air redirect apparatus 100 with the adjustable cover plate 104 set to a maximum length 116B, according to aspects described herein.

The cover plate 104 of the air redirect apparatus 100 may have an adjustable length 116 that is operable to be adjusted from a minimum length 116A (see FIGS. 8A and 8B) to a maximum length 116B (see FIG. 9). (Note that, for purposes herein, the length of the cover plate will be designated as reference number 116, while its minimum length will be designated as 116A and its maximum length will be designated as 116B.) The maximum length 116B is greater than the maximum length 25 (see FIG. 2) of the duct opening 24. Additionally, the width 118 of the cover plate 104 is wider than the maximum width 23 of the duct opening 24. Accordingly, the length of the cover plate 104 can be adjusted to cover the entire cross sectional area of the duct opening 24 in order to block substantially all air flow around the duct elbow 102.

To provide an adjustable length 116, the cover plate 104 may be a cover plate assembly 104 that includes a top plate 120 and a bottom plate 122. The top plate 120 may have a first pair of retainer tabs 124 disposed on a first longitudinal side of the top plate 120 and a second pair of retainer tabs 126 disposed on an opposing second longitudinal side of the top plate 120.

The cover plate assembly 104 may also include a bottom plate 122 having a thickness sized to slidably fit within the first and second pairs of retainer tabs 124, 126 of the top plate 120. The bottom plate 122 may include a cutout section 128 configured to straddle an outer perimeter of the entrance aperture 106 of the duct elbow 102. The bottom plate 122 may be operable to slide longitudinally within the first and second pairs of retainer tabs 124, 126 to adjust the length 116 of the cover plate 104 between the minimum length 116A and the maximum length 116B.

Figure 10:
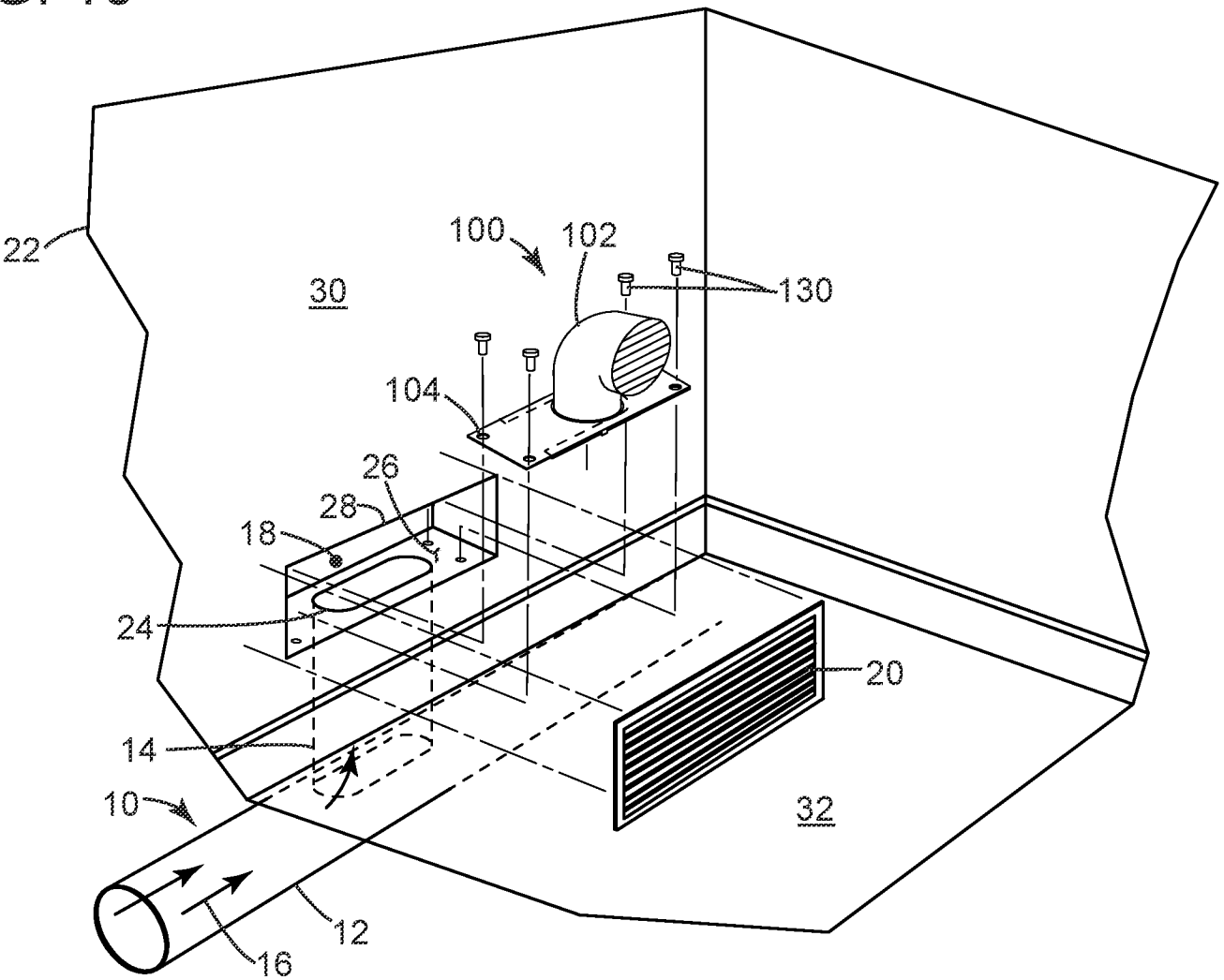
FIG. 10 depicts an example of an exploded view of the air redirect apparatus of FIG. 4, according to aspects described herein.

Referring to FIG. 10, an example is depicted of an exploded view of the air redirect apparatus 100, according to aspects described herein. The exploded view illustrates how the air redirect apparatus 100 is assembled into the register access cavity 18 and over the duct opening 24 of ductwork 14. The register 20 covers the air redirect apparatus 100, but allows the air flow 16 to pass through. The air redirect apparatus 100 may be fastened to the cavity floor 26 with any number of appropriate fasteners 130.

Figure 12:
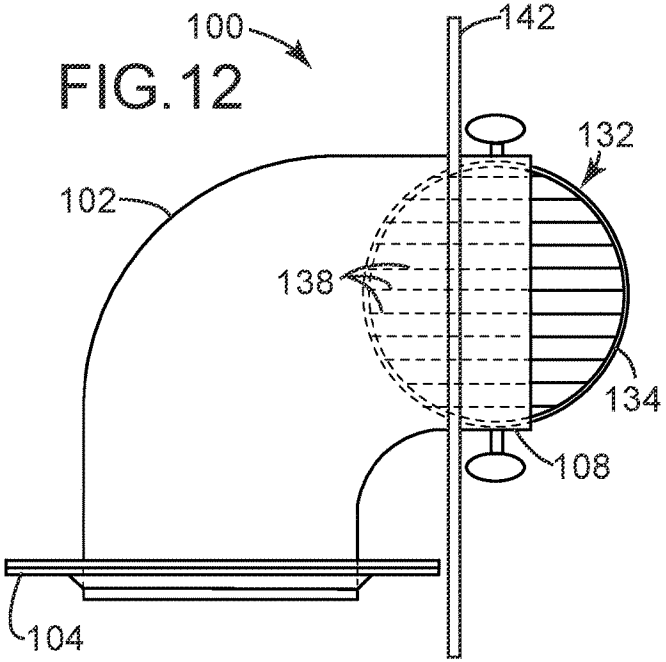
FIG. 12 depicts an example of a side view of the air redirect apparatus of FIG. 11, according to aspects described herein.
Figure 11:
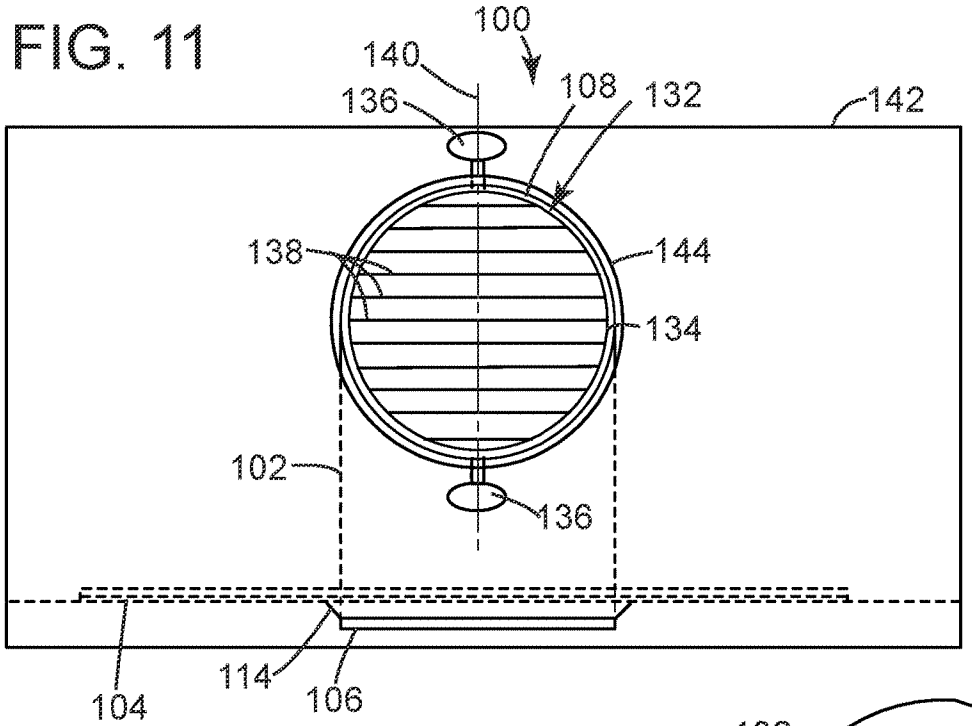
FIG. 11 depicts an example of a front view of another air redirect apparatus having an air redirect valve disposed in an exit aperture of a duct elbow of the air redirect apparatus, according to aspects described herein.
Figure 13:
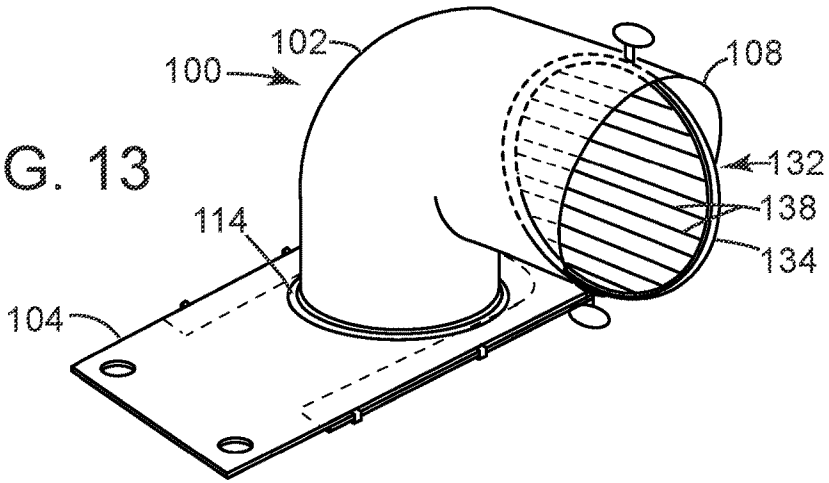
FIG. 13 depicts an example of a perspective view of the air redirect apparatus of FIG. 11, according to aspects described herein.

Referring to FIGS. 11, 12 and 13, an example is depicted of a front view (FIG. 11) a side view (FIG. 12) and a perspective view (FIG. 13) of another air redirect apparatus 100 having an air redirect valve 132 disposed within the exit aperture 108 of the duct elbow 102 of the air redirect apparatus 100, according to aspects described herein.

The air redirect valve disposed 132 includes a valve frame 134 having an outer perimeter which substantially conforms to an inner perimeter of the exit aperture 108. In the example illustrated in FIGS. 11-13, the valve frame 134 of the air redirect valve 132 is a ring shaped valve frame 134 having a substantially circular outer perimeter which substantially conforms to a substantially circular inner perimeter of the exit aperture 108.

The valve frame 134 is pivotally connected to a top wall portion and an opposing bottom wall portion of the exit aperture 108 by pivot pins 136 such that the valve frame 134 is operable to rotate clockwise and counterclockwise relative to the cover plate 104 to direct forced air flow 16 leftward or rightward into the room 22. In the example illustrated in FIGS. 11-13, the ring shaped valve frame 134 is pivotally connected to the top and bottom wall portions of the exit aperture 108 across an axis 140 of the ring 134 which extends through a diameter of the ring 134.

The air redirect valve 132 also includes a plurality of substantially parallel louvers 138 extending across the valve frame 134. The louvers 138 are operable to pivot upward and downward to direct forced air flow 16 upward or downward into the room 22.

The air redirect apparatus also includes a register replacement plate 142, which is used to replace the register 20. The register replacement plate 142 has an exit aperture hole 144 that is configured to receive the exit aperture 108 of the duct elbow 102 therethrough. The register replacement plate 142 is operable to mount over the wall opening 28 (see FIG. 2) of the register access cavity 18. The air redirect valve 132 combined with the register replacement plate 142 enables the air redirect apparatus 100 to control direction of air flow 16 in both the leftward/rightward direction and the upward/downward direction without having to remove the register 20.

Figure 15:
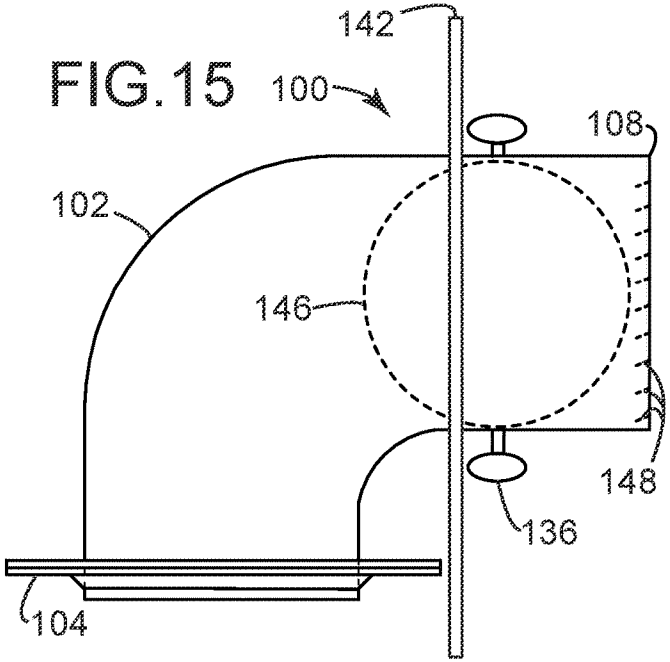
FIG. 15 depicts an example of a side view of the air redirect apparatus of FIG. 14, according to aspects described herein.
Figure 14:
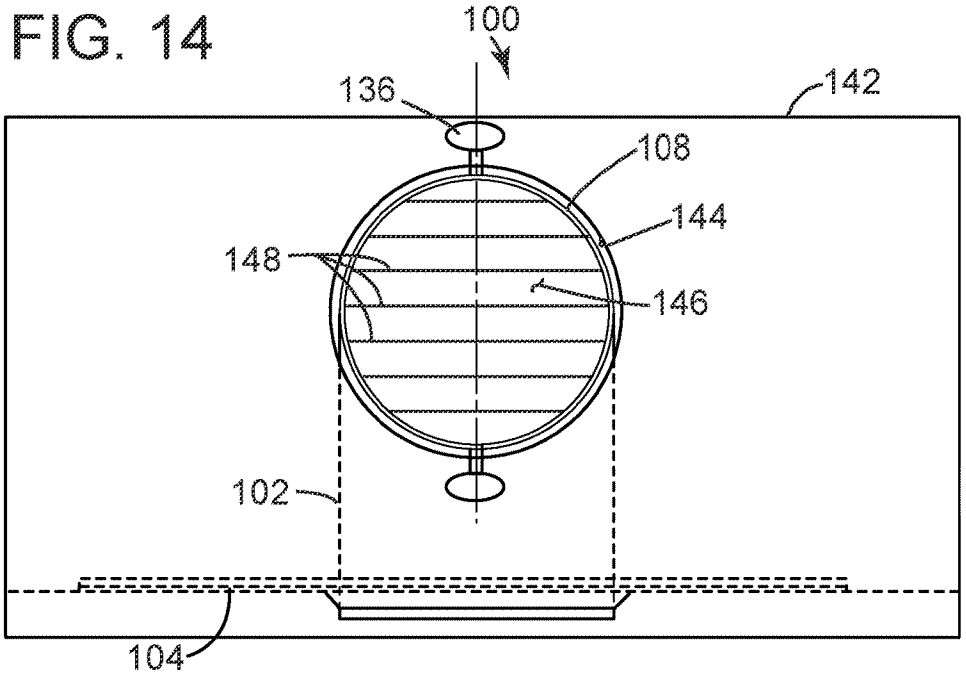
FIG. 14 depicts an example of a front view of another air redirect apparatus having an air redirect plate disposed in a duct elbow of the air redirect apparatus, according to aspects described herein.
Figure 16:
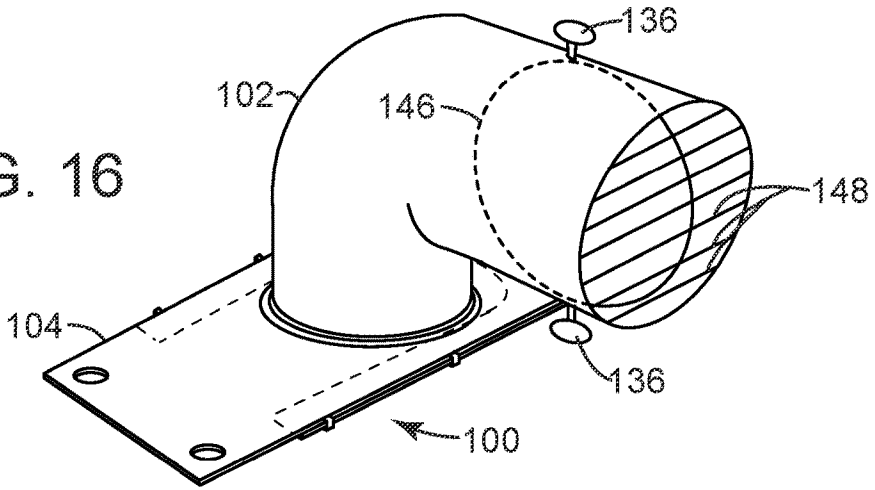
FIG. 16 depicts an example of a perspective view of the air redirect apparatus of FIG. 14, according to aspects described herein.

Referring to FIGS. 14, 15 and 16, an example is depicted of a front view (FIG. 14), a side view (FIG. 15) and a perspective view (FIG. 16) of another air redirect apparatus 100 having an air redirect plate 146 disposed in the duct elbow 102 of the air redirect apparatus 100, according to aspects described herein.

A plurality of substantially parallel louvers 148 extend across the exit aperture 108 of the duct elbow 102. The louvers 148 are operable to pivot upward and downward to direct forced air flow 16 upward or downward.

The air redirect plate 146 is disposed within the duct elbow 102 proximate the exit aperture 108 and upstream of the louvers 148. The air redirect plate 146 includes an outer perimeter which substantially conforms to an inner perimeter of the duct elbow 102. The air redirect plate 146 is pivotally connected to a top wall portion and an opposing bottom wall portion of the duct elbow 102 via, for example, pivot pins 136, such that the air redirect plate 146 is operable to rotate clockwise and counterclockwise relative to the cover plate 104 to direct forced air flow leftward or rightward. The air redirect plate 132 and louvers 148 combined with the register replacement plate 142 enables the air redirect apparatus 100 to control direction of air flow 16 in both the leftward/rightward direction and the upward/downward direction without having to remove the register 20.

It should be appreciated that all combinations of the foregoing concepts and additional concepts discussed in greater detail herein (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

Although the invention has been described by reference to specific examples, it should be understood that numerous changes may be made within the spirit and scope of the inventive concepts described. Accordingly, it is intended that the disclosure not be limited to the described examples, but that it have the full scope defined by the language of the following claims.

What is claimed is:

1. An air redirect apparatus for redirecting forced air through a register access cavity, the apparatus comprising:

a duct configured to fit into a register access cavity, the duct comprising an entrance aperture and an exit aperture, the entrance aperture sized to connect to a duct opening of ductwork which routes forced air into the register access cavity; and a cover plate connected to the entrance aperture and through which the entrance aperture penetrates, the cover plate operable to cover the duct opening of the ductwork when the entrance aperture is connected to the duct opening;

wherein the cover plate has an adjustable length that is operable to be adjusted between a minimum length and a maximum length, the maximum length being greater than a maximum length of the duct opening;

wherein the cover plate comprises:

a first plate having a first pair of retainer tabs disposed on a first longitudinal side of the first plate and a second pair of retainer tabs disposed on an opposing second longitudinal side of the first plate; and a second plate having a thickness sized to slidably fit within the first and second pairs of retainer tabs of the first plate, the second plate including a cutout section configured to straddle an outer perimeter of the entrance aperture of the duct the second plate operable to slide longitudinally within the first and second pairs of retaining tabs to adjust the length of the cover plate between the minimum length and the maximum length.

2. The air redirect apparatus of claim 1, wherein when the duct is fit into the register access cavity, air flow from the ductwork is routed into the entrance aperture and directed out of the exit aperture of the duct, while the cover plate substantially blocks air flow around the duct.

3. The air redirect apparatus of claim 1, wherein velocity of forced air directed out of the exit aperture, and into a room is greater than velocity of forced air directed into the room when the duct is not connected to the duct opening of the duct work.

4. The air redirect apparatus of claim 1, comprising: the entrance aperture and exit aperture of the duct each having a cross sectional area that is less than the cross sectional area of the duct opening; and wherein velocity of the forced air being directed out of the exit aperture is greater than velocity of forced air passing through the ductwork adjacent to the duct opening.

5. The air redirect apparatus of claim 1, comprising: the cover plate pivotably connected to the entrance aperture such that the duct is operable to rotate clockwise and counterclockwise relative to the cover plate to direct forced air flow leftward or rightward.

6. The air redirect apparatus of claim 1, comprising: a plurality of substantially parallel louvers extending across the exit aperture of the duct, the louvers operable to pivot upward and downward to direct forced air flow upward or downward.

7. The air redirect apparatus of claim 6, comprising an air redirect plate disposed within the duct proximate the exit aperture and upstream of the louvers, the air redirect plate comprising: an outer perimeter which substantially conforms to an inner perimeter of the duct, the air redirect plate pivotally connected to a top wall portion and an opposing bottom wall portion of the duct such that the air redirect plate is operable to rotate clockwise and counterclockwise relative to the cover plate to direct forced air flow leftward or rightward.

8. The air redirect apparatus of claim 1, comprising:

an air redirect valve disposed within the exit aperture, the air redirect valve comprising:

a valve frame having an outer perimeter which substantially conforms to an inner perimeter of the exit aperture, the valve frame pivotally connected to a top wall portion and an opposing bottom wall portion of the exit aperture such that the valve frame is operable to rotate clockwise and counterclockwise relative to the cover plate to direct forced air flow leftward or rightward, and a plurality of substantially parallel louvers extending across the valve frame, the louvers operable to pivot upward and downward to direct forced air flow upward or downward.

9. The air redirect apparatus of claim 8, comprising:

the valve frame of the air redirect valve comprising a ring shaped valve frame having a substantially circular outer perimeter which substantially conforms to a substantially circular inner perimeter of the exit aperture, the ring shaped valve frame pivotally connected to the top and bottom wall portions of the exit aperture across an axis of the ring which extends through a diameter of the ring.

10. The air redirect apparatus of claim 8, comprising:

a register replacement plate having an exit aperture hole configured to receive the exit aperture therethrough, the register replacement plate operable to mount over a wall opening of the register access cavity.

11. An air redirect apparatus for redirecting forced air through a register access cavity, the apparatus comprising:

a duct configured to fit into a register access cavity, the duct comprising an entrance aperture and an exit aperture, the entrance aperture sized to connect to a duct opening of ductwork which routes forced air into the register access cavity, the duct having a minimum cross sectional area that is less than the cross sectional area of the duct opening;

a cover plate connected to the entrance aperture and through which the entrance aperture penetrates, the cover plate sized to cover the duct opening of the ductwork when the entrance aperture is connected to the duct opening; and wherein when the duct is fit into the register access cavity, air flow from the ductwork is routed into the entrance aperture and directed out of the exit aperture of the duct, while the cover plate substantially blocks air flow around the duct; and wherein velocity of forced air being directed out of the exit aperture is greater than velocity of forced air passing through the ductwork adjacent to the duct opening;

wherein the cover plate has an adjustable length that is operable to be adjusted between a minimum length and a maximum length, the maximum length being greater than a maximum length of the duct opening;

wherein the cover plate comprises:

a first plate having a first pair of retainer tabs disposed on a first longitudinal side of the first plate and a second pair of retainer tabs disposed on an opposing second longitudinal side of the first plate; and a second plate having a thickness sized to slidably fit within the first and second pairs of retainer tabs of the first plate, the second plate including a cutout section configured to straddle an outer perimeter of the entrance aperture of the duct the second plate operable to slide longitudinally within the first and second pairs of retaining tabs to adjust the length of the cover plate between the minimum length and the maximum length.

12. The air redirect apparatus of claim 11, wherein the entrance aperture and the exit aperture are oriented at substantially 90 degrees relative to each other.

13. The air redirect apparatus of claim 11, comprising: the cover plate pivotably connected to the entrance aperture such that the duct is operable to rotate clockwise and counterclockwise relative to the cover plate to direct forced air flow leftward or rightward.

14. The air redirect apparatus of claim 11, comprising: a plurality of substantially parallel louvers extending across the exit aperture of the duct, the louvers operable to pivot upward and downward to direct forced air flow upward or downward.

15. The air redirect apparatus of claim 14, comprising an air redirect plate disposed within the duct proximate the exit aperture and upstream of the louvers, the air redirect plate comprising: an outer perimeter which substantially conforms to an inner perimeter of the duct, the air redirect plate pivotally connected to a top wall portion and an opposing bottom wall portion of the duct such that the air redirect plate is operable to rotate clockwise and counterclockwise relative to the cover plate to direct forced air flow leftward or rightward.

16. The air redirect apparatus of claim 11, comprising:

an air redirect valve disposed within the exit aperture, the air redirect valve comprising:

a valve frame comprising a substantially circular outer perimeter which substantially conforms to a substantially circular inner perimeter of the exit aperture, the valve frame pivotally connected to a top wall portion and an opposing bottom wall portion of the exit aperture such that the valve frame is operable to rotate clockwise and counterclockwise relative to the cover plate to direct forced air flow leftward or rightward, and a plurality of substantially parallel louvers extending across the valve frame, the louvers operable to pivot upward and downward to direct forced air flow upward or downward.

17. The air redirect apparatus of claim 16, comprising:

a register replacement plate having an exit aperture hole configured to receive the exit aperture therethrough, the register replacement plate operable to mount over a wall opening of the register access cavity.

* * * * *